US005460934A

United States Patent [19]

Delton

[11] Patent Number: 5,460,934

[45] Date of Patent: Oct. 24, 1995

[54] CHLORIDE CONTAINING HIGH BROMIDE ULTRATHIN TABULAR GRAIN EMULSIONS

[75] Inventor: Mary H. Delton, Honeove Falls, N.Y.

[73] Assignee: Eastman Kodak Company, Rochester, N.Y.

[21] Appl. No.: 304,034

[22] Filed: Sep. 9, 1994

Related U.S. Application Data

[63] Continuation-in-part of Ser. No. 139,971, Oct. 21, 1993, Pat. No. 5,372,927, and a continuation-in-part of Ser. No. 238, 119, May 4, 1994, abandoned.

[51] Int. Cl.[6] ..... G03C 1/035; G03C 1/08

[52] U.S. Cl. ..... 430/567; 430/570

[58] Field of Search ..... 430/567, 570

[56] References Cited

U.S. PATENT DOCUMENTS

| | | | |
|---|---|---|---|
| 4,414,310 | 11/1983 | Daubendick et al. | 430/567 |
| 4,433,048 | 2/1984 | Solberg et al. | 430/567 |
| 4,434,226 | 2/1984 | Wilgus et al. | 430/567 |
| 4,439,520 | 3/1984 | Kofron et al. | 430/567 |
| 4,693,964 | 9/1987 | Daubendick et al. | 430/505 |
| 4,914,010 | 4/1990 | Momoki | 430/567 |
| 4,914,014 | 4/1990 | Daubendiek et al. | 430/569 |
| 5,059,517 | 10/1991 | Ikama et al. | 430/567 |
| 5,061,609 | 10/1991 | Piggin et al. | 430/569 |
| 5,250,403 | 10/1993 | Antoniades et al. | 430/505 |
| 5,290,676 | 3/1994 | Nagaoka et al. | 430/567 |

FOREIGN PATENT DOCUMENTS

| | | |
|---|---|---|
| 362699A3 | 4/1990 | European Pat. Off. . |

*Primary Examiner*—Janet C. Baxter
*Attorney, Agent, or Firm*—Carl O. Thomas

[57] ABSTRACT

Tabular grain emulsions are disclosed in which the tabular grains have average thicknesses of less than 0.07 μm and average equivalent circular diameters of at least 0.7 μm. These ultrathin tabular grain emulsions are improved by the incorporation of at least 0.4 mole percent chloride along with >50 mole percent bromide and, optionally, iodide. Greater than 97 percent of total grain projected area can be accounted for by the tabular grains. The emulsions exhibit reduced pressure sensitivity, exhibit increased developability and exhibit reduced native sensitivity to the blue region of the spectrum.

11 Claims, 1 Drawing Sheet

CHLORIDE CONTAINING HIGH BROMIDE ULTRATHIN TABULAR GRAIN EMULSIONS

This is a continuation-in-part of U.S. Ser. No. 139,971, filed Oct. 21, 1993, now U.S. Pat. No. 5,372,427, and U.S. Ser. No. 238,119, filed May 4, 1994, now abandoned.

FIELD OF THE INVENTION

The invention is directed to improved tabular grain photographic emulsions.

BACKGROUND

Figure 1:
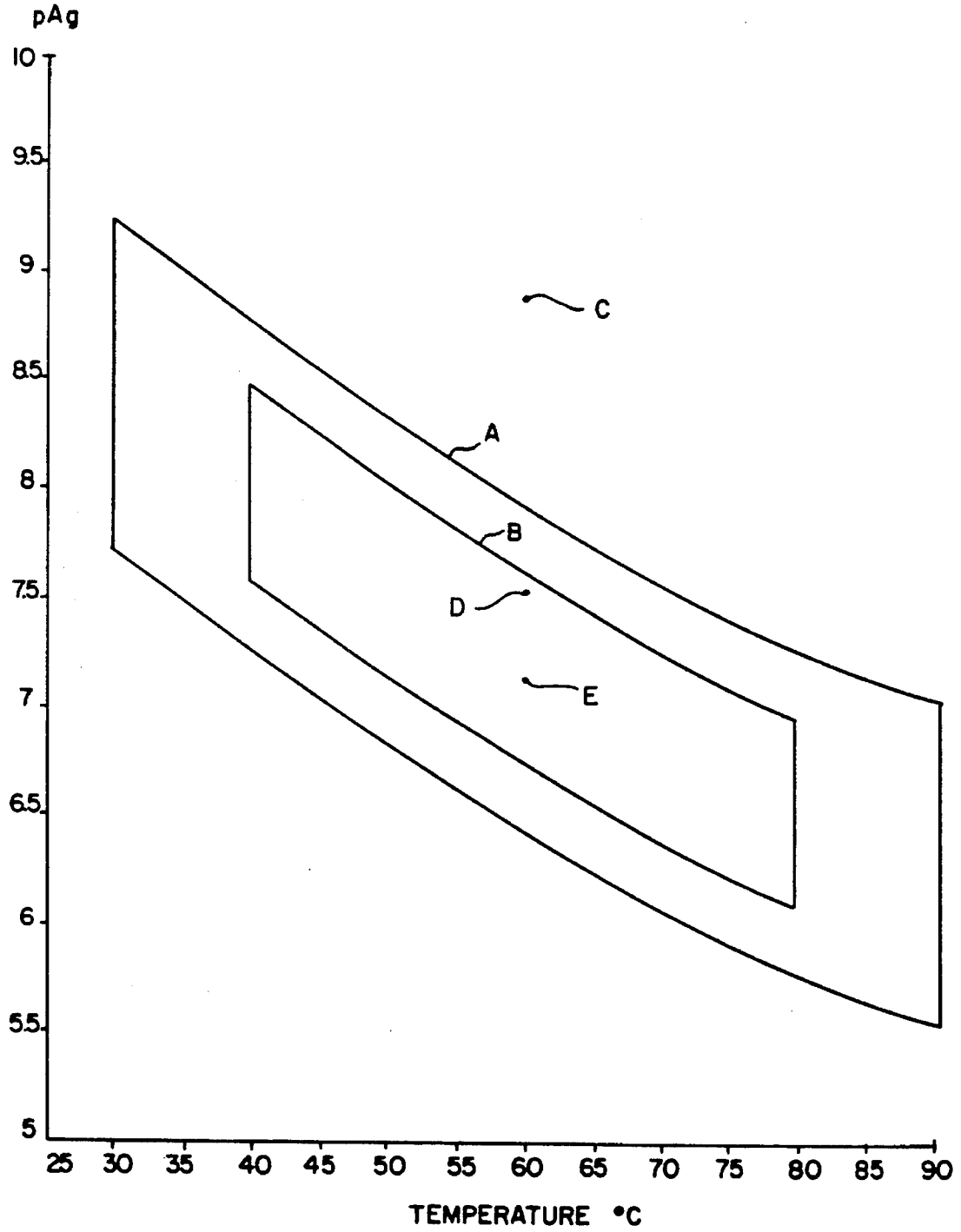
FIG. 1 is a plot of pAg versus temperature in degrees Celsius. Curves A and B also appear in Piggin et al U.S. Pat. Nos. 5,061,609 and 5,061,616.

In referring to silver halide grains containing two or more halides, the halides are named in their order of increasing concentration. Halide ion concentrations are stated in mole percent, based on silver, where the silver is the total silver forming the tabular grain structure, unless otherwise stated.

The term "tabular grain emulsion" is employed herein to designate emulsions in which at least 50 percent of total grain projected area is accounted for by tabular grains. Tabular grains are those grains which have two parallel major crystal faces that are significantly larger than any remaining grain face.

A variety of photographic advantages have been recognized to be realizable employing tabular grain emulsions. These advantages include, but are not limited to, improved speed-granularity relationships, increased image sharpness, a capability for more rapid processing, increased covering power, reduced covering power loss at higher levels of forehardening, higher gamma for a given level of grain size dispersity, less image variance as a function of processing time and/or temperature variances, higher separations of blue and minus blue speeds, the capability of optimizing light transmission or reflection as a function of grain thickness and reduced susceptibility to background radiation damage in very high speed emulsions.

Initially interest in tabular grain emulsions focused on high aspect ratio tabular grain emulsions, those in which the average aspect ratio of the tabular grains is greater than 8. Aspect ratio is defined by the relationship:

$$ECD/t \quad (I)$$

where

ECD is the equivalent circular diameter of a tabular grain and t is thickness of the tabular grain, both ECD and t being expressed in the same units, typically micrometers (μm). Subsequently it was realized that tabular grain emulsions with at least moderate (≧5) average aspect ratios are also superior for many applications, provided the average thickness of the tabular grains is not high, typically less than 0.2 μm.

Ultrathin tabular grain emulsions, those in which the average thickness of the tabular grains accounting for at least 50 percent of total grain projected area is less than 0.07 μm, have been reported in a few instances. Daubendiek et al U.S. Pat. Nos. 4,693,964 and 4,914,014 report ultrathin tabular grain silver bromide and iodobromide emulsions, but with average ECD's well below 0.7 μm. It is much more difficult to prepare ultrathin tabular grain emulsions of any composition with an average ECD of at least 0.7 μm. Ultrathin silver iodobromide tabular grains with an ECD of >0.7 μm are reported by Daubendiek et al U.S. Pat. No. 4,414,310 and Antoniades et al U.S. Pat. No. 5,250,403. Silver iodobromide tabular grain emulsions which come close to being ultrathin are disclosed in Zola et al EPO 0 362 699A3.

Although the possibility of precipitating high (>50 mole percent) bromide tabular grain emulsions in the presence of chloride ion has been suggested, it must be borne in mind that the solubility of silver chloride is approximately two orders of magnitude higher than that of silver bromide and the solubility of silver bromide is much greater than two orders of magnitude higher than of silver iodide. Thus, when mixtures of halide ions are present during precipitation, often no incorporation of chloride ion into the grain structure can be detected, where the minimum detectable chloride ion concentration is 0.4 mole percent. When precipitation conditions are adjusted to permit significant chloride ion incorporation into the tabular grain structure, they are not favorable for satisfying ultrathin tabular grain thickness requirements.

Momoki U.S. Pat. No. 4,914,010 reports tabular grain emulsions containing from 2 to 4 mole percent chloride, no iodide and the balance bromide. The tabular grains have an average aspect ratio of not less than 5 with average ECD's in the range of from 0.1 to 10 μm. In the sole Example tabular grain emulsion preparation reported the mean ECD was 0.7 μm and the mean grain thickness was 0.14 μm, indicating that the grains were more than twice maximum ultrathin requirements by the time the moderate ECD of 0.7 μm had been achieved. The tabular grains accounted for 80 percent of total grain projected area, indicating the presence of a significant nontabular grain population.

Momoki illustrates that high bromide ultrathin tabular grain emulsions containing detectable levels of chloride ion have not been realized in moderate and higher (at least 0.7 μm) ranges by those working in the art. This has deprived high bromide ultrathin tabular grain emulsions of moderate and higher ECD's of the advantages known to be attributable to the incorporation of chloride ion—e.g., more rapid developability and reduced native blue absorption.

While high bromide tabular grain emulsions have advanced the state of the art in almost every grain related parameter of significance in silver halide photography, one area of concern has been the susceptibility of tabular grain emulsions to vary their photographic response as a function of the application of localized pressure on the grains. For example, kinking or otherwise applying pressure locally to a photographic element containing a high bromide tabular grain emulsion results in a visually detectable variation in optical density in the area of pressure application.

Piggin et al U.S. Pat. Nos. 5,061,609 and 5,061,616 disclose processes of preparing high aspect ratio tabular grain silver iodobromide emulsions in which the iodide is nonuniformly distributed in the form of laminae on the major faces of the grains to improve speed-granularity relationships. To minimize sensitivity variance as a function of applied pressure, either the higher iodide laminae or overlying silver bromide laminae are formed within the boundary of Curve A (preferably Curve B) by precipitation pAg and temperature. pAg is the negative logarithm of silver ion activity. pBr is the negative logarithm of bromide ion activity. At equilibrium pAg is related to pBr in silver bromide and iodobromide emulsions by the relationship:

$$-\log K_{sp}=pBr+pAg \quad \text{(II)}$$

where pBr and pAg are as defined above and

Ksp is the solubility product constant of silver bromide.

The presence of minor amounts of iodide ion in silver iodobromide emulsions does not significantly alter pBr, since the equilibrium solubility of silver iodide is lower than that of silver bromide by much more than two orders of magnitude.

Piggin et al in each patent teaches the formation of laminae on the major faces of the tabular grains to reduce sensitivity variance as a function of locally applied pressure. The teachings of Piggin et al in each patent lead inescapably to the conclusion that in the process disclosed the tabular grains must be inherently increased in thickness to reduce their variation in photographic response as a function of locally applied pressure.

The techniques taught by Piggin et al for reducing pressure sensitivity in silver iodobromide tabular grain emulsions is at odds with the general recognition of the art that precipitation of high bromide tabular grain emulsions at pBr values of greater than 2.2 are to be avoided. For Example, Wilgus et al U.S. Pat. No. 4,434,226, Solberg et al U.S. Pat. No. 4,433,048 and Kofron et al U.S. Pat. No. 4,439,520 all disclose that high bromide tabular grain growth should be limited to a pBr of less than 2.2 to avoid thickening of the tabular grains. Since the upper boundary of Curve A in FIG. 1 corresponds to a pBr of 2.8, a pBr of 2.2 lies well above the upper boundary of Curve A.

SUMMARY OF THE INVENTION

In one aspect this invention is directed to a radiation-sensitive emulsion comprised of a dispersing medium and silver halide grains in which greater than 50 percent of total grain projected area is accounted for by tabular silver halide grains exhibiting an average aspect ratio of greater than 5, wherein the tabular silver halide grains have an average equivalent circular diameter of at least 0.7 μm and an average thickness of less than 0.07 μM and the tabular grains contain from 0.4 to 20 mole percent chloride and 0 to 10 mole percent iodide, based on silver, the balance of the halide being bromide.

Surprisingly, it has been possible to incorporate significant, detectable concentrations of chloride ions into the ≧0.7 μm mean ECD tabular grains while retaining their average thicknesses below the 0.07 μm upper thickness limit of ultrathin tabular grain emulsions. Further, not only have the ultrathin tabular grains been improved by incorporating the known advantages attendant to chloride ion incorporation, but in addition reductions in pressure induced variations in sensitivity have been realized. This latter advantage runs directly counter to the teachings of the art that thickening of tabular grains must be accepted to reduce pressure sensitivity. Finally, the advantages of the ultrathin tabular grains have been maximized by producing emulsions in which these grains account for greater than 97 percent of total grain projected area.

DESCRIPTION OF PREFERRED EMBODIMENTS

The present invention is directed to an improvement in conventional silver bromide and iodobromide ultrathin tabular grain emulsions of ≧0.7 μm mean ECD's in which minor amounts of chloride ion have been incorporated into the tabular grain structure. The known advantages of chloride ion incorporation into these tabular grain structures are realized. In addition, the pressure sensitivity of the tabular grain emulsions is reduced.

The emulsions of the present invention are prepared by modifying the preparation of conventional ≧0.7 μm mean ECD silver bromide and iodobromide ultrathin tabular grain emulsions over a portion of grain growth to incorporate chloride ion. Ultrathin ≧0.7 μm mean ECD silver bromide and iodobromide tabular grain emulsions and their preparations are disclosed by Daubendiek et al U.S. Pat. Nos. 4,414,310 and Antoniades et al 5,250,403, the disclosures of which are here incorporated by reference. Although Antoniades et al is directed specifically to silver iodobromide ultrathin tabular grain emulsions, it is well recognized in the art (e.g., see Kofron et al U.S. Pat. No. 4,439,520) that precipitations of silver iodobromide tabular grain emulsions can be converted to precipitations of silver bromide tabular grain emulsions merely by eliminating iodide, with no increase in tabular grain thickness or reduction in tabular grain average aspect ratios. Hence the teachings of Antoniades et al are fully applicable to both silver bromide and iodobromide ultrathin tabular grain emulsions.

It has been discovered that ultrathin tabular grain emulsions similar to those reported by Daubendiek et al and Antoniades et al, but differing by the incorporation of significant, measurable concentrations of chloride ions and reduced pressure sensitivity can be prepared by modifying a portion of the ultrathin tabular grain growth process. Specifically, these advantages are realized when 5 to 60 (preferably 20 to 40) percent of silver is precipitated within the boundaries of Curve A (preferably within the boundaries of Curve B) in FIG. 1 and in the presence of chloride ion. The molar concentration of chloride ion present in the dispersing medium during precipitation must be higher than that sought to be incorporated into the ultrathin tabular grains based on total silver, since only a fraction of the precipitation is conducted under conditions favorable for chloride ion introduction into the grains.

The portion of the precipitation conducted within the boundaries of Curve A and preferably within the boundaries of Curve B in FIG. 1 are hereinafter also referred to as the modified portion of grain growth. The upper and lower boundaries of Curve A correspond to pBr values of 2.8 and 4.3, respectively. The upper and lower boundaries of Curve B correspond to pBr values of 3.2 and 4.0, respectively. The Side boundaries of Curves A and B are not critical. The boundaries of Curve A located at 30° C. and 90° C. were chosen because these temperatures represent practically attractive temperature boundaries for emulsion preparation. The boundaries of Curve B located at 40° C. and 80° C. embrace the temperatures most commonly employed in emulsion manufacture. Since the boundaries of Curve B lie entirely within the boundaries of Curve A, all subsequent references to curve boundaries satisfying the requirements of the modified portion of grain growth reference only Curve A, but it is to be understood that the Curve B boundaries are in all instances the preferred boundaries.

The mechanism by which chloride introduction during the modified portion of the growth step results in reductions in pressure sensitivity in the ultrathin tabular grain emulsions produced is not understood. However, investigations suggest that grain growth within the boundaries of Curve A is conducive to reducing defects, including defects introduced by grain growth prior to adjusting pAg within the boundaries of Curve A. For this reason it is generally contemplated that the maximum benefits in terms of reduction of pressure sensitivity are to be realized by choosing the final portion of the growth step to be the modified portion.

This same preference applies when the advantage being sought from chloride ion introduction is development acceleration, since the nearer the chloride is to the latent image site or sites formed on a grain the greater is the opportunity for development acceleration. Typically latent image sites in tabular grains are located disproportionately at their edges and corners, which are, of course, the last precipitated portions of the grains.

Contrary to the teachings of Piggin et al, cited above, reduction in pressure induced performance variance of the emulsions of this invention is entirely independent of iodide placement in the tabular grains and can, in fact, be realized in emulsions prepared according to the process of the invention that contain no silver iodide.

A further surprising discovery is that low levels of iodide in the dispersing medium during the modified portion of the growth step can contribute significant reductions in the thicknesses of the ultrathin tabular grains produced. It is taught by Wilgus et al U.S. Pat. No. 4,434,226 that even very small amounts of iodide—e.g., as low as 0.05 mole percent—are recognized to in the art to be beneficial in improving photographic performance. It has been observed that the known advantages of iodide incorporation and the heretofore unknown reduction in the thickness of the ultrathin tabular grains can be realized with iodide concentrations ranging up to 10 mole percent, based on silver. For maximum reductions in tabular grain thicknesses iodide concentrations of from 0.5 to 5 mole percent, based on silver, are preferably incorporated into the ultrathin tabular grains during the modified portion of the growth step. In most instances the overall iodide concentrations in the ultrathin tabular grains correspond to the iodide concentrations introduced during the modified portion of the growth step. However, the advantages to be realized by iodide introduction during the modified portion of grain growth are not dependent on the level of iodide in the portion of the tabular grain grains previously precipitated. For example, this feature of the invention is fully applicable to ultrathin tabular grains that, prior to performing the modified portion of grain growth, contain no iodide.

Achieving ultrathin tabular grains that contain chloride and exhibit reduced levels of pressure sensitivity cannot be achieved by employing any single pAg level for precipitation. The levels of pAg that can be employed throughout tabular grain precipitation to produce ultrathin tabular grains are well above the upper boundary of Curve A in FIG. 1. At these pAg levels of precipitation no measurable quantities of chloride are incorporated into the grains and the grains exhibit significant pressure sensitivity. If, on the other hand, precipitation is attempted entirely within the boundary of Curve A in FIG. 1, high bromide tabular grains that contain chloride and, optionally, iodide are obtained, but the tabular grains exhibit average thicknesses significantly greater than the 0.07 μm maximum average thickness art recognized to represent the upper thickness limit of ultrathin tabular grains. Thus, at least two different pAg levels are required for the successful precipitation of chloride containing high bromide ultrathin tabular grain emulsions satisfying the requirements of the invention.

The requirement of employing at least two different pAg levels during precipitation limit the maximum chloride ion inclusion that can be realized while obtaining ultrathin tabular grain emulsions. Based on the Examples reported below chloride ion concentrations in the ultrathin tabular grain emulsions of up to 20 mole percent, based on silver, are contemplated. The minimum chloride ion concentration has been set at 0.4 mole percent, which is the lowest conveniently detectable level of chloride ion. It is preferred that the ultrathin tabular grains contain at least 1 mole percent chloride, based on silver. Further, it is preferred to limit the maximum concentration of chloride to 15 mole percent, based on silver. The balance of the halide content of the ultrathin tabular grains not accounted for by chloride and iodide, when present, is provided by bromide.

Apart from the features specifically discussed the ultrathin tabular grain emulsions of this invention and their preparation can take any of the various forms taught by Daubendiek et al and Antoniades et al, cited and incorporated by reference above. Preferred ultrathin tabular grain emulsions are those in which the tabular grains account for greater than 70 percent of total grain projected area. The precipitation techniques of Antoniades et al are capable of producing ultrathin tabular grain emulsions in which ultrathin tabular grains account for substantially all (>97%) of total grain projected area. The modified portion of grain growth required by the present invention has no adverse effect on the percentage of the total grain population accounted for by tabular grains. The present invention is the first to provide a high bromide ultrathin tabular grain emulsion containing significant levels of chloride incorporation in which the tabular grains account for greater than 97 percent of total grain projected area.

Antoniades et al teaches that the ultrathin tabular grains can have average thicknesses ranging down to 0.01 μm as a minimum. The modified portion of grain growth contemplated by the present invention results in somewhat higher ultrathin tabular grain minimum thicknesses, typically at least about 0.04 μm. Somewhat lower minimum average ultrathin tabular grain thicknesses are considered attainable when precipitations are optimized for that result.

Since the tabular grain emulsions of this invention have thicknesses of less than 0.07 μm, it is apparent from relationship (I) above that the average aspect ratios of the emulsions can range up to or near the very highest levels heretofore observed in preparing tabular grain emulsions for photographic use. With average grain ECD values for photographic applications being limited to less than 10 μm as an extreme and for the overwhelming majority of photographic applications to less than 5 μm, average aspect ratios of greater than 100 and up to 200 can be realized. In a specifically preferred form of the invention the average grain ECD is at least 1.0 μm, and the corresponding average aspect ratio is greater than 14.

The exact location that chloride ions occupy within the ultrathin tabular grains has not been determined. Since silver chloride is much more soluble than silver bromide or silver iodide, chloride ions cannot displace previously precipitated bromide and/or iodide from within the host grain structure onto which precipitation is occurring. Thus, chloride is located within that portion of the ultrathin tabular grains that is precipitated during the modified portion of grain growth. During microscopic examination of grain samples it has been observed that chloride ion addition can result in the initial sharpening of grain edges and corners; however, ripening effects during and following precipitation are capable of readily returning the grain edges and corners to more rounded forms. Since iodide ions are much the least soluble of the halide ions forming photographic silver halide grains, immediate precipitation of iodide ions occurs, regardless of the pAg level at which precipitation is occurring. Since abrupt variances in iodide concentrations can be disruptive to ultrathin tabular grains, particularly in the earlier stages of precipitation, it is contemplated that any variances in iodide concentrations as precipitation is progressing will be gradual rather than abrupt.

The incorporation and use of the emulsions in photographic elements can take any convenient form. Photographic element features and their use are summarized in *Research Disclosure*, Vol. 308, December 1989, Item 308119. *Research Disclosure* is published by Kenneth Mason Publications, Ltd., Dudley House, 12 North St., Emsworth, Hampshire P010 7DQ, England.

EXAMPLES

The invention can be better appreciated by reference to the following specific examples, significant parameters of which are summarized in Tables I and II. Each emulsion was examined by scanning electron microscopy (SEM) and shown to consist almost entirely (>97% of total grain projected area) of hexagonal and triangular tabular grains. The speeds (measured at a density of 0.15 above fog) of the emulsions described below were evaluated as an emulsion layer on a photographic film support, the emulsion layer exhibiting a coating density of 16.1 mg/dm$^2$ silver. The emulsion layer was exposed through a graduated density step tablet for 0.5 second by a 365 nm line radiation source and then processed for 8 minutes in a hydroquinoneElon™ (N-methyl-p-aminophenol hemisulfate) developer commercially available as Kodak D-76 developer.

Pressure induced variances of photographic speed were measured by comparing the speed difference between coatings with and without the application of 0.17 kPa (25 psi) roller pressure before exposure. To avoid any possibility of attributing differences in response to pressure to differences in sensitization, the emulsions were coated and compared without undertaking chemical or spectral sensitization.

Example 1C (a comparative example)

In this example a tabular grain emulsion was prepared in which all of the growth silver was added at a conventional pAg (pAg=9, 60° C.) for high bromide high aspect ratio tabular grain emulsion preparation. The pAg is shown as point C in FIG. 1.

The purpose of this example is to provide a point of reference illustrating tabular grain thickness when pAg is maintained at a conventional level outside the boundaries of Curve A in FIG. 1 and no chloride is present during the preparation of an iodobromide high aspect ratio tabular grain emulsion.

A total of 3.3 moles of silver iodobromide were precipitated in the following manner:

A reaction vessel equipped with a stirrer was charged with 3.2 L of distilled water, 35 mL of 2N $H_2SO_4$, 20 mL of 1N NaBr, 7.5 gm of hydrogen peroxide treated, non-deionized, lime-processed bone gelatin, and an antifoamant at 35° C. The pH was 1.9 and the pAg was 9.5. Nucleation was accomplished by simultaneous addition of 10 mL each of 2N solutions of $AgNO_3$ and NaBr at a rate of 0.012 mol/min. Immediately thereafter, the temperature was raised to 60° C. over a 15 min period. Then 50 gm of gel (same as above) in 250 mL of water were added, the pH was adjusted to 6.0 with dilute NaOH, and enough 1N NaBr was added to adjust the pAg to 9.0. The first growth step was begun by the simultaneous addition of 1.6N $AgNO_3$ and AgI at the constant rate of 0.038 mol Ag/min for 10 min during which time 1.75N NaBr was also added at a rate to maintain the measured pAg. The second growth step was a linear ramp from 0.038 to 0.092 mol Ag/min over 40 min and used exactly the same growth salt solutions as the first growth step with the pAg held constant at 9. When growth was complete, the emulsion was cooled to 40° C. and isolated by adding 40 mL of an aqueous solution of 25% by weight phthalated gelatin. The emulsion was then washed twice by the coagulation method described in Yutzy et al U.S. Pat. No. 2,614,929, and 250 mL of an aqueous solution of 30% by weight bone gelatin were added. The pH and pAg of the emulsion were adjusted to 6.0 and 9.2, respectively at 40° C.

The resulting tabular grain emulsion exhibited an average ECD and an tabular grain thickness as reported in Table I.

When coatings of this emulsion were subjected to roller pressure before exposure and compared to the same coatings with no applied pressure, the coatings that were not pressure treated were 0.21 log E (E represents exposure in lux-seconds) lower in speed than those that were. This indicated a high level of pressure sensitivity.

Example 2C (a comparative example)

This example demonstrates the effect of shifting precipitation from point C in FIG. 1 to point D for the final 14 percent of silver precipitation during grain growth.

This emulsion was precipitated exactly like that of Example 1C, but with the following exception: During the second growth step, when the amount of silver Precipitated was equal to 86% of the total to be precipitated, the addition of growth salts was stopped, and the pAg was adjusted to 7.5 (point D in FIG. 1) by the addition of 1.9N $AgNO_3$. Thereafter, growth was continued as before, but at the 7.5 pAg value.

The emulsion was isolated as in Example 1C. The resulting tabular grain emulsion exhibited an average ECD and an tabular grain thickness as reported in Table I. By referring to Table I it is apparent that grains exhibited a thickness increase resulting from the low pAg growth step.

When coatings of this emulsion were subjected to roller pressure before exposure and compared to the same coatings with no applied pressure, the coatings that were not pressure treated were 0.135 log E lower in speed than those that were. This indicated a lower level of pressure sensitivity than was observed for the emulsion of Example 1.

Examples 3E-6E

The emulsion precipitation of Example 2 was repeated, except that immediately prior to the start of the first growth step, an amount of 1N NaCl equal to 9.14 mole % (Example 3E), 4.59 mole % (Example 4E), 1.57 mole % (Example 5E), or 0.77 mole % (Example 6E) of the total silver to be precipitated was dumped into the reaction vessel.

The average ECD's of the grains of Examples 3E, 4E, 5E, and 6E were 1.31, 1.21, 1.29, and 1.30 μm, respectively, and their average thicknesses were 0.051, 0.047, 0,052, and 0.056 μm, respectively. Referring to Table I it is apparent that the introduction of chloride offset the increase in tabular grain thickness induced by shifting the latter stage of grain growth from a pAg of 9.0 to 7.5. Although the incorporated levels of chloride were not measured for these emulsions, it is apparent by comparison that the chloride incorporation in the emulsions of Examples 3E and 4E was greater the 0.9 mole percent chloride found in the Example 9E emulsion.

When coatings of the emulsion of Example 4E were subjected to roller pressure before exposure and compared to the same coatings with no applied pressure, the coatings that were not pressure treated were 0.075 logE lower in speed than were the coatings that had pressure applied before exposure. This demonstrated that the presence of chloride not only prevented tabular grain thickening due to the low pAg of the latter stage of grain growth, but also further reduced the pressure induced sensitization of the emulsion.

Examples 7E and 8E

The emulsion preparations of Example 2C were repeated, except that after the growth pAg shift to pAg=7.5, enough NaCl was added to the remaining NaBr growth salt solution to obtain 1.32 mole % chloride (Example 7E) or 0.44 mole % chloride (Example 8E).

The resulting ultrathin tabular grain emulsions exhibited average ECD's and tabular grain thicknesses as reported in Table I.

Example 9E

The emulsion precipitation of Example 4E was repeated, except that an amount of 1N NaCl equal to 4.58 mole % of the total silver to be precipitated was dumped into the reaction vessel immediately prior to the pAg shift rather than prior to the start of growth.

The resulting ultrathin tabular grain emulsion exhibited an average ECD and an tabular grain thickness as reported in Table I. The tabular grains contained 0.9 mole percent chloride, based on silver.

Example 10E

The emulsion precipitation of Example 9E was repeated, except that the last 14% of silver was added at pAg=7.15 (point E in FIG. 1) instead of at pAg=7.5 (point D).

The resulting ultrathin tabular grain emulsion exhibited an average ECD and an tabular grain thickness as reported in Table I. Although chloride incorporation was not measured for this emulsion, a higher chloride incorporation than in Example 9E resulted from the lower pAg for the final portion of the growth step.

Example 11C (a comparative example)

The emulsion precipitation of Example 2C was repeated, except that no iodide was introduced into the emulsion.

The silver bromide emulsion was examined by SEM and observed to consist almost entirely of tabular grains. The edges and corners of the tabular grains were rounded. The tabular grain emulsion exhibited an average ECD and an tabular grain thickness as reported in Table I.

Example 12C (a comparative example)

The emulsion precipitation of Example 11C was repeated, except that the first 70% (rather than 86%) of silver addition occurred at high pAg (pAg=9, 60° C.) while the last 30% of silver was added at a pAg=7.5.

The silver bromide emulsion was examined by SEM and observed to consist almost entirely of tabular grains. The edges and corners of the tabular grains were rounded. The resulting tabular grain emulsion exhibited an average ECD and an average tabular grain thickness as reported in Table I.

EXAMPLE 13E

The emulsion precipitation of Example 12C was repeated, except that immediately prior to the start of the first growth step, a quantity of 1N NaCl equal to 4.7 mole % of the total silver to be precipitated was dumped into the reaction vessel.

The silver bromide emulsion was examined by SEM and observed to consist almost entirely of tabular grains. The edges and corners of the tabular grains were noticeably less rounded than those of Example 12C. The resulting ultrathin tabular grain emulsion exhibited an average ECD and an tabular grain thickness as reported in Table I. Chloride in a concentration of 1.9 mole percent, based on silver, was found to be present in the tabular grains.

Examples 14E–16E

The emulsion precipitation of Example 11C was repeated, except that immediately prior to the start of the first growth step, a quantity of 1N NaCl equal to 9.37 mole % (Example 14E), 4.70 mole % (Example 15E), or 3.16 mole % (Example 16E) of the total silver to be precipitated was dumped into the reaction vessel.

Tabular grain emulsions consisting almost entirely of tabular grains were obtained. The emulsions were examined by SEM, revealing tabular grains with hexagonal or triangular major faces. The edges and corners of the tabular grains were noticeably less rounded than in Example 11C. The resulting ultrathin tabular grain emulsions each exhibited an average ECD and an tabular grain thickness as reported in Table I. By referring to the summary of properties in Table I it is apparent that the thicknesses of the tabular grains in these example emulsions were significantly lower than those of comparative Example 11C.

The chloride ion concentrations in the emulsions of Examples 14E and 15E were 1.9 and 0.8 mole percent, based on silver, respectively. By extrapolation the chloride content of the emulsion of Example 16E was estimated to be between 0.6 and 0.7 mole percent, based on silver.

Example 17E

The emulsion precipitation of Example 14E was repeated, except that the one half of the 9.37 mole % of NaCl based on total silver introduced, was added immediately prior to the start of the first growth step and the other half was added immediately prior to the shift to pAg 7.5.

The resulting ultrathin tabular grain emulsion exhibited an average ECD and an tabular grain thickness as reported in Table I. Chloride ion incorporation was not measured, but by comparison can be seen to be similar to that of the emulsion of Example 14E.

Example 18E

Precipitation was conducted as in Example 17E, except that pAg was shifted from point C to point D for the final 30 percent of the growth silver introduction. The resulting ultrathin tabular grain emulsion exhibited an average ECD and an tabular grain thickness as reported in Table I. Chloride in a concentration of 9.41 mole percent was present in solution and chloride in a concentration of 2.6 mole percent, based on silver, was found to be present in the tabular grains.

Example 19E

Precipitation was conducted as in Example 18E, except that 3 mole percent iodide was present in solution, pAg was shifted to 7.1 instead of 7.5 and the chloride ion concentration in solution was 9.88 mole percent. The resulting ultrathin tabular grain emulsion exhibited an average ECD and an tabular grain thickness as reported in Table I. Chloride in a concentration of 5.1 mole percent, based on silver, was found to be present in the tabular grains. The fact that the higher chloride incorporation was not accompanied by tabular grain thickening is attributed to the influence of the iodide ion.

Example 20C

Precipitation was conducted as in Example 3E, except that pAg was maintained at 7.5 throughout the growth step and the chloride ion concentration in solution was 4.28 mole percent. The resulting tabular grain emulsion exhibited an average ECD and an average tabular grain thickness as reported in Table I. The tabular grains were too thick to be ultrathin tabular grains. Chloride in a concentration of 4.3 mole percent, based on silver, was found to be present in the tabular grains. This Example demonstrates that conducting growth entirely at point D succeeds in incorporating chloride, but produces grains that are too thick to satisfy ultrathin thickness requirements. Example 21C Precipitation was conducted as in Example 20C, except that the iodide ion concentration was reduced from 3.0 to 2.5 mole percent and the chloride ion concentration in solution was increased to 24.88 mole percent, resulting in the incorporation of 14.9 mole percent chloride. This Example corroborates Example 20C in showing that grain growth entirely at point D succeeds in incorporating chloride, but produces grains that are too thick to satisfy ultrathin thickness requirements. The tabular grain emulsion exhibited an average ECD and an average tabular grain thickness as reported in Table I.

Example 22E

Precipitation was conducted as in Example 19E, except that the iodide ion concentration was reduced from 3.0 to 1.8 mole percent, the final growth pAg was increased to 7.5 and the chloride ion concentration in solution was 10.00 mole percent, resulting in the incorporation of 6.2 mole percent chloride. The resulting ultrathin tabular grain emulsion exhibited an average ECD and an tabular grain thickness as reported in Table I.

Example 23E

Precipitation was conducted as in Example 18E, except that the final pAg was maintained for the final 50 percent of growth silver introduction and the chloride ion concentration in solution was 12.56 mole percent. The resulting ultrathin tabular grain emulsion exhibited an average ECD and an tabular grain thickness as reported in Table I. Chloride in a concentration of 7.9 mole percent, based on silver, was found to be present in the tabular grains.

Example 24E

Precipitation was conducted as in Example 19E, except that no iodide was present during precipitation and the chloride ion concentration in solution was 9.80 mole percent. The resulting ultrathin tabular grain emulsion exhibited an average ECD and an tabular grain thickness as reported in Table I. Chloride in a concentration of 7.3 mole percent, based on silver, was found to be present in the tabular grains.

Since the solution chloride ion concentrations of Examples 19E and 24E are very similar, the emulsions provide a clear illustration of the effect of iodide. That is, the 0,008 μm reduction in ultrathin tabular grain thickness in Example 19E is a result of the presence of the 3 mole percent iodide during precipitation. The fact that iodide is capable of contributing to the further thinning of the ultrathin tabular grains was unexpected. Chloride in a concentration of 15.6 mole percent, based on silver, was found to be present in the tabular grains.

Example 25E

Precipitation was conducted as in Example 19E, except that the iodide concentration was reduced to 2.5 mole percent, the final growth at a pAg of 7.1 was increased to 40 percent of the growth silver, and the chloride ion concentration in solution was increased to 20.20 mole percent, based on silver. The resulting ultrathin tabular grain emulsion exhibited an average ECD and an tabular grain thickness as reported in Table I.

Example 26E

Precipitation was conducted as in Example 25E, except that the iodide concentration was increased to 5.0 mole percent. The resulting ultrathin tabular grain emulsion exhibited an average ECD and an tabular grain thickness as reported in Table I. Chloride in a concentration of 17.3 mole percent, based on silver, was found to be present in the tabular grains.

TABLE I

| Ex | Growth pAg (% Ag) | I M % | Soln. Cl M % | Grain Cl M % | ECD μm | t μm | ECD t |
|---|---|---|---|---|---|---|---|
| 1C | 9.0(100%) | 3 | 0 | 0 | 1.30 | .047 | 27.7 |
| 2C | 9.0(86%)/7.5(14%) | 31 | 0 | 0 | 1.08 | .068 | 15.9 |
| 3E | 9.0(86%)/7.5(14%) | 3 | 9.14 | — | 1.31 | .051 | 25.8 |
| 4E | 9.0(86%)/7.5(14%) | 3 | 4.59 | — | 1.21 | .047 | 25.7 |
| 5E | 9.0(86%)/7.5(14%) | 3 | 1.57 | — | 1.29 | .052 | 24.8 |
| 6E | 9.0(86%)/7.5(14%) | 3 | 0.77 | — | 1.30 | .056 | 23.2 |
| 7E | 9.0(86%)/7.5(14%) | 3 | 1.32 | — | 1.24 | .058 | 21.4 |
| 8E | 9.0(86%)/7.5(14%) | 3 | 0.44 | — | 1.24 | .060 | 20.7 |
| 9E | 9.0(86%)/7.5(14%) | 3 | 4.58 | 0.9 | 1.24 | .054 | 23.2 |
| 10E | 9.0(86%)7.15(14%) | 3 | 4.55 | — | 1.33 | .054 | 24.6 |
| 11C | 9.0(86%)/7.5(14%) | 0 | 0 | 0 | 1.04 | .063 | 16.5 |
| 12C | 9.0(70%)/7.5(30%) | 0 | 0 | 0 | .896 | .086 | 10.4 |
| 13E | 9.0(70%)/7.5(30%) | 0 | 4.70 | 1.9 | 1.07 | .064 | 16.7 |

TABLE I-continued

| Ex | Growth pAg (% Ag) | I M % | Soln. Cl M % | Grain Cl M % | ECD µm | t µm | ECD t |
|---|---|---|---|---|---|---|---|
| 14E | 9.0(86%)/7.5(14%) | 0 | 9.37 | 1.9 | 1.06 | .058 | 18.3 |
| 15E | 9.0(86%)/7.5(14%) | 0 | 4.70 | 0.8 | 1.20 | .055 | 21.8 |
| 16E | 9.0(86%)/7.5(14%) | 0 | 3.16 | — | 1.10 | .057 | 19.3 |
| 17E | 9.0(86%)/7.5(14%) | 0 | 9.37 | — | 1.12 | .056 | 20.1 |
| 18E | 9.0(70%)/7.5(30%) | 0 | 9.41 | 2.6 | 1.06 | .057 | 18.6 |
| 19E | 9.0(70%)/7.1(30%) | 3 | 9.88 | 5.1 | 1.20 | .054 | 22.2 |
| 20C | 7.5(100%) | 3 | 4.28 | 4.3 | 0.47 | .171 | 2.8 |
| 21C | 7.5(100%) | 2.5 | 24.88 | 14.9 | 0.62 | .142 | 4.4 |
| 22E | 9.0(70%)/7.5(30%) | 1.8 | 10.00 | 6.2 | 1.11 | .059 | 18.8 |
| 23E | 9.0(50%)/7.5(50%) | 0 | 12.56 | 7.9 | 0.98 | .064 | 15.3 |
| 24E | 9.0(70%)/7.1(30%) | 0 | 9.8 | 7.3 | 1.03 | .062 | 16.6 |
| 25E | 9.0(60%)/7.1(40%) | 2.5 | 20.20 | 15.6 | 1.09 | .067 | 16.3 |
| 26E | 9.0(60%)/7.1(40%) | 5.0 | 20.28 | 17.3 | 1.13 | 1.063 | 17.9 |

Example 27

Further observations were conducted to determine the deviation of tabular grain thicknesses. As reported by Buhr et al Research Disclosure, Vol. 253, May 1985, Item 25330, small differences in tabular grain thicknesses can have a significant impact on tabular grain reflectance as a function of wavelength in the visible portion of the spectrum.

The standard deviations of representative emulsions from the Examples above are compared in Table II.

TABLE II

| Ex | Cl M % | ECD | t | t, std dev | AR |
|---|---|---|---|---|---|
| 2C | 0 | 1.08 | .068 | .0068 | 15.9 |
| 4E | 4.59 | 1.21 | .047 | .0043 | 25.7 |
| 11C | 0 | 1.04 | .063 | .0079 | 16.5 |
| 14E | 9.37 | 1.06 | .058 | .0068 | 18.3 |
| 17E | 9.37 | 1.12 | .056 | .0064 | 20.0 |

From Table II it is apparent that chloride addition not only reduces tabular grain thicknesses, but additionally reduces the variation of tabular grain thicknesses from grain to grain.

Example 28

This example has its purpose to demonstrate that an increase in both photographic speed and contrast is produced by the inclusion of chloride in the ultrathin tabular grains.

Emulsions 11C (0M % Cl) and 15E (4.7M % Cl) were each optimally sulfur and gold sensitized, spectrally sensitized with the green spectral sensitizing dyes anhydro-5-chloro-9-ethyl-5'-phenyl-3'-(3-sulfo-butyl)-3-(3-sulfopropyl)oxacarbocyanine hydroxide, sodium salt and anhydro-11-ethyl-1,1'-bis(3-sulfopropyl)naphth[ 1,2-d] oxazolocarbocyanine hydroxide, sodium salt, and identically coated on a film support at a silver coating density of 8.07 mg/dm$^2$.

Each coating was exposed through a graduated test object for 0.01 second using an Eastman 1B ™ sensitometer and a Wratten 9 ™ filter to intercept light at wavelengths shorter than 500 nm. The exposed coatings were processed using a development time of 2 minutes in the C-41 Flexicolor ™ color negative process.

The sensitometric results are summarized in Table III. Speed is reported as relative log speed (30 speed units=0.3 log E, where E represents exposure in lux-seconds) measured at a density of 0.15 above minimum density. Gamma is mid-scale contrast.

TABLE III

| Emulsion | Speed | Gamma |
|---|---|---|
| 11C | 168 | 2.38 |
| 15E | 177 | 2.52 |

From Table III it is apparent that Emulsion 15E satisfying the requirements of the invention exhibited a significantly higher speed and contrast than control emulsion 11C, which was similar, except that it contained no chloride.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains in which greater than 50 percent of total grain projected area is accounted for by tabular silver halide grains exhibiting an average aspect ratio of greater than 5, WHEREIN the tabular grains have an average equivalent circular diameter of at least 0.7 µm and an average thickness of less than 0.07 µm and the tabular silver halide grains contain from 0.4 to 20 mole percent chloride and 0 to 10 mole percent iodide, based on silver, the balance of the halide being bromide.

2. A radiation-sensitive emulsion according to claim 1 wherein the tabular grains contain at least 1 mole percent chloride, based on silver.

3. A radiation-sensitive emulsion according to claim 2 wherein the tabular grains contain up to 15 mole percent chloride, based on silver.

4. A radiation-sensitive emulsion according to claim 3 wherein the tabular grains additionally contain from 0.05 to 10 mole percent iodide, based on silver.

5. A radiation-sensitive emulsion according to claim 4 wherein the tabular grains contain from 0.5 to 5 mole percent iodide.

6. A radiation-sensitive emulsion according to claim 1 wherein the tabular grains account for greater than 70 percent of total grain projected area.

7. A radiation-sensitive emulsion according to claim 6 wherein the tabular grains account for greater than 97 percent of total grain projected area.

8. A radiation-sensitive emulsion according to claim 1 wherein the tabular grains exhibit an average equivalent circular diameter of at least 1.0 µm and an average aspect ratio of greater than 14.

9. A radiation-sensitive emulsion according to claim 1 wherein a green or red spectral sensitizing dye is adsorbed to the tabular grains.

10. A radiation-sensitive emulsion comprised of a dispersing medium and silver halide grains in which greater than 70 percent of total grain projected area is accounted for by tabular silver halide grains exhibiting an average aspect ratio of greater than 8, WHEREIN the tabular grains have an average equivalent circular diameter of at least 0.7 μm and an average thickness of from less than 0.07 μm to 0.04 μm and the tabular silver halide grains contain from 1 to 15 mole percent chloride and from 0.5 to 5 mole percent iodide, based on silver, the balance of the halide forming the grains being bromide.

11. A radiation-sensitive emulsion according to claim 10 wherein the tabular grains account for greater than 97 percent of total grain projected area and exhibit an average equivalent circular diameter of at least 1.0 μm.

* * * * *